United States Patent [19]

Newman

[11] 3,989,569

[45] Nov. 2, 1976

[54] CONTINUOUS COPYING METHOD

[75] Inventor: Douglas A. Newman, Glen Cove, N.Y.

[73] Assignee: Columbia Ribbon and Carbon Manufacturing Co., Inc., Glen Cove, N.Y.

[22] Filed: Feb. 10, 1975

[21] Appl. No.: 548,281

[52] U.S. Cl. ..... 156/234; 156/231; 427/144; 427/140; 427/288; 427/428; 118/212; 118/257; 118/253

[51] Int. Cl.[2] ..... B41C 1/06

[58] Field of Search ..... 156/230, 231, 234, 238; 118/211, 212, 247, 257, 253; 427/144, 428, 288, 141, 445; 197/168, 49, 171, 126 R; 101/219, 336, DIG. 7

[56] References Cited

UNITED STATES PATENTS

| | | | |
|---|---|---|---|
| 2,475,336 | 7/1949 | Petz | 197/168 |
| 2,559,649 | 7/1951 | Little et al. | 156/231 |
| 2,674,974 | 4/1954 | Gwinn et al. | 118/211 |
| 2,984,342 | 5/1961 | Smith | 118/212 |
| 3,230,106 | 1/1966 | West | 427/288 X |

*Primary Examiner*—Ralph S. Kendall
*Attorney, Agent, or Firm*—Thomas L. Tully

[57] ABSTRACT

A continuous ink-transfer printing system employing a hot-melt wax imaging composition supported on a strong pressure-conforming plastic film web which is continuously recoated with fresh imaging composition to replace imaging composition which is imagewise transferred at a pressure-imaging station. The system comprises an ink-coating station, a pressure-imaging station and an ink-melting station associated with the ink-coating station.

5 Claims, 1 Drawing Figure

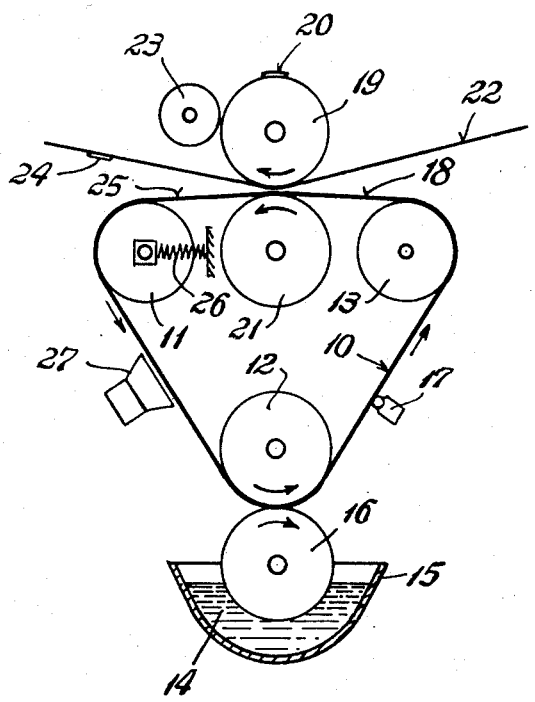
20
23
19
22
24
25
18
26
21
13
11
10
27
12
17
16
15
14

CONTINUOUS COPYING METHOD

The present invention relates to a method for overcoming the waste and/or shut-down time encountered with printing devices and machines which employ transfer elements coated with imagewise pressure-transferable solid imaging composition and which discard such transfer elements after a single use even though such used transfer elements still carry from 60 up to 90% or more of the original imaging composition. Most prior systems of this type employ individual transfer sheets while some employ the transfer element as a ribbon or continuous roll.

It is not possible to reuse the used transfer sheet, ribbon or roll since portions of the imaging layer have been pressure-transferred during the first pass through the imaging station and any overlapping of image forces between the first imaging and the second imaging will result in the formation of images on the second copy sheet which contain voids and are illegible or, in the case of hectograph images, will not reproduce legible images, or, in the case of magnetic or optical compositions, are not reliably automatically-sensible.

These problems cannot be overcome by merely recoating the transfer element because the recoated imaging composition will build up in thickness in the unused areas, resulting in the pressure-transfer of images which are not sharp or clear, and/or the recoated imaging composition will not have uniform transfer properties. These disadvantages are critically important with respect to imaging devices involving pressure-transfer. In a pressure-transfer device such as a printing machine, adding machine, typewriter, or the like, a thick wax transfer layer will broaden or spread under impact and a non-uniform or double wax layer will transfer in a spotty or non-uniform manner to produce images which are not uniform in thickness or density.

It is the principal object of the present invention to provide a novel continuous ink-transfer printing system employing a continuous pressure-sensitive transfer element which is continuously supplied with a fresh, uniform, thin wax imaging layer after each use without wasting the wax imaging composition remaining on the transfer element after the first use.

It is another object of the present invention to provide a novel method for coating and recoating a strong pressure-conforming plastic film web with a uniform, thin layer of pressure-transferable imaging composition, the imaging composition remaining on the web after the imagewise transfer of portions thereof during each use being removed and/or redistributed and supplemented for reuse.

It is still another object of this invention to provide a novel printing apparatus containing means for continuously recoating a continuous transfer element with wax transfer composition, to replace portions thereof used in the pressure-transfer operation, in such a manner that a fresh, uniform, thin, pressure-transferable wax imaging layer is continuously presented at the printing station.

It is yet another object of this invention to provide a strong, continuous, pressure-conforming plastic film belt transfer element which is continuously supplied with a fresh, uniform, thin, pressure-transferable wax imaging layer after each use and which is adapted for continuous reuse without distortion under the effects of the heat encountered during the repeated melting and coating cycles and under the effects of pressure encountered during the repeated impact-transfer copying cycles.

These and other objects and advantages of the present invention will be apparent to those skilled in the art in the light of the present disclosure including the drawing which illustrates a schematic side view of a system according to the present invention.

The present invention resides in the discovery of a novel continuous pressure-imaging system employing a continuous pressure-sensitive transfer web in endless band form or in continuous roll form, said web comprising a pressure-conforming strong plastic film which has memory properties and is resistant to loss of dimensional stability when repeatedly heated to the melting temperature of the pressure-transferable imaging layer present thereon. The latter is a hot-melt or solvent-applied wax coating which is heat-meltable and heat-flowable on the plastic film and is resistant to oxidation or other chemical reaction which changes the original melting temperature and/or frangibility properties of the imaging layer with age, whereby the imaging layer can be continuously remelted and replaced such as by supplementing and redistributing additional imaging composition on the plastic film support to continuously provide a fresh new imaging layer which is homogeneous and uniform in thickness, appearance and transfer properties.

One suitable system employing a continuous endless film web is illustrated by the drawing. Thus, the film web 10 is supported for continuous movement by means of a dance roll 11, backing roll 12, and a chill roll 13. To begin a cycle, the film web 10 passes over backing roll 12 so that its outer surface receives a coating of molten wax imaging composition 14 from heated vat 15 applied by means of heated application roll 16. The coated web then passes against an equalizer rod 17 which levels the coating to a uniform predetermined thickness. The web carrying the uniform wax imaging layer then passes over the chill roll 13 which completes the solidification of the imaging layer 18 prior to arrival of the latter at the pressure-transfer station.

The pressure-transfer station comprises a printing cylinder 19 carrying a raised type plate 20 and an impression cylinder 21. Positioned between the printint cylinder 19 and the imaging layer 18 is a continuous web 22 of copy paper which is to receive the transfer composition from imaging layer 18 under the printing pressure exerted by the raised type plate 20. Also shown is an inking roll 23 which supplies the surface of the raised type on plate 20 with a supply of liquid ink which is transferred to the upper surface of the copy web 22 at the same time that the undersurface of web 22 receives corresponding portions of the imaging layer 18. This is important for proofreading purposes in cases where the images on plate 20 are reverse images and cause formation of reverse images on the underside of the copy web 22, such as where the copy web 22 is a hectograph master sheet and the imaging layer 18 is a hectograph transfer composition.

At the pressure-transfer station, the plastic film web 10 carrying the imaging layer 18 and the copy web 22 are compressed together between the impression cylinder 21 and the surface of the raised type plate 20 on the print cylinder 19. This causes the copy web 22 and the plastic film web 10 to be pressure-distorted to conform to the configuration of the type faces on the print cylinder 19 whereby portions of the imaging layer transfer from film web 10 to copy web 22 as images 24 in areas corresponding to the pressure exerted by the type faces.

The used imaging layer 25, containing void areas from which portions of the imaging composition have been transferred, then passes over a dance roll 11 having a spring load 26 which maintains the film web 10 under tension, and then under a heater 27 which melts the imaging layer 25 and reduces it to flowable condition on the film web 10. Thereafter the film web 10 begins a new cycle as it receives a new supply of imaging composition 14 from application roll 16 which mixes uniformly with the melted imaging composition remaning on the web after the previous cycle, the combined composition is levelled as a uniform layer by equalizer rod 17 and solidified bu chill roll 13 prior to re-arrival at the pressure-transfer station.

The most critical elements of the present invention are the plastic film web and the transfer composition. The former must be a strong material which is resistant to significant dimensional change under the effects of continuous heating to a temperature of about 200° F, and which is pressure-deformable in the printing operation but has memory properties such that it returns to its original planal levelness substantially immediately after the printing pressure is relaxed. Thus, the momentary pressure distortions formed in the web 10 disappear before the web is reinked and are not present to receive ink and form areas of greater ink concentration and greater thickness than other areas of the film web 10. Most plastic films have this disadvantage and cannot be used according to the present invention because the bagging or permanent pressure-deformations of such films prevent the reformation of uniformly thin imaging layers and thus result in pressure-transferred images which are not uniform in sharpness, uniformity or density and/or dye concentration.

Preferred plastic films for use as the endless film webs or continuous roll film webs of the present invention are the oriented films of polyethylene terephthalate (Mylar), polyvinyl fluoride (Teslar) and polytetrafluoroethylene. Such films have the necessary heat-stability and memory properties required by the present process. Most preferred are those films which are oriented uniformly in all directions such as tensilized polyethylene terephthalate, available under the trademark Mylar A. Also suitable are laminates of such heat-stable memory films. In all cases, the films or laminates must have a thickness of from about 0.5 mil up to about 1.5 mils.

Suitable wax imaging compositions are those which have a relatively sharp melting point ranging between about 150° and 200° F and are substantially free of solid materials which do not melt within this range other than inert pigments, dyestuffs and fillers, and free of oxidizable or chemically-reactive ingredients which can react and change the properties of the composition with age. The preferred wax binder material is carnauba wax but other waxes such as ouricury wax, paraffin wax, beeswax, and the like, can also be used alone or in mixtures with each other or with carnauba wax. Semi-solid waxes can also be included such as lanolin and petroleum. Inert oils such as castor oil, mineral oil, refined rapeseed oil, peanut oil, and the like, are also included in amounts ranging from about 0.5 to about 1.5 times the weight of the wax binder material.

The coloring matter present depends upon the nature of the imaging composition. For hectograph compositions, a solid undissolved spirit-soluble dye such as crystal violet is included in an amount of from about 40 to 75% of the weight of the total composition. However, other pigments such as magnetic iron oxide, carbon black, nigrosine, and the like, may be used to form magnetically-sensible, optically-sensible, and other compositions as desired.

The wax imaging composition preferably is a hot-melt-applied composition which is coated and solidified in the manner discussed supra in connection with the drawing. However it is also possible to use conventional solvent wax imaging compositions which comprise the wax binder material dispersed in finely-divided form in a volatile vehicle which is substantially a non-solvent for the wax and for the finely-divided hectograph dyestuff in the case of hectograph compositions. Such compositions are printed onto the film belt or web by a printing roller and solidified by heating to evaporate the volatile vehicle. After passing the pressure-transfer station, the used coating is remelted in the same manner as a hot-melt-applied wax imaging layer and the remelted coating is continuously scraped from the film belt or web and collected for re-dispersion in the volatile vehicle and reuse.

According to a preferred embodiment, the remelting of the used wax imaging layer and/or the evaporation of the volatile vehicle from a solvent-applied wax imaging composition may be accomplished by means of an infrared radiation source provided that the wax imaging composition contains an infrared radiation-absorbing material such as carbon black, other black pigment or a commercially-available infrared-absorbing chemical. For instance, up to about 5% by weight of carbon black can be incorporated into a hectograph wax composition to render it infrared-absorbing whereby exposure of the composition, in the form of a solid layer on the film foundation, to an infrared lamp will cause the solid layer to melt quickly.

The following example illustrates the formation of one suitable imaging composition 14 for use in vat 15 of the system illustrated by the drawing.

| Ingredients | Parts by Weight |
|---|---|
| Carnauba wax | 15 |
| Castor oil | 6.8 |
| Lanolin | 6.3 |
| Mineral oil | 14 |
| Carbon black | 3.5 |
| Crystal violet dye | 54.4 |

The ingredients are ground together in a ball mill for 2 hours at a temperature of about 185° F to form a uniform molten mixture which is added to vat 15. The mixture is maintained at about this temperature by heating means associated with the vat and associated with application roll 16.

Variations and modifications may be made within the scope of the claims and portions of the improvements may be used without others.

I claim:

1. Continuous pressure-copying method comprising the steps of coating a continuous web of heat-resistant, memory-possessing plastic film with a uniformly thin original layer of heat-meltable pressure-transferable solid wax imaging composition to form a transfer element, moving said web to a pressure-transfer station where imagewise portions of said solid layer are pressure-transferred to a copy sheet under the effects of imaging pressure applied to said transfer element, and moving said used coated heat-resistant web to a recoating station where the used coating is heat-melted to a flowable condition, replaced with a fresh coating of identical imaging composition in a uniform thickness corresponding to the thickness of the original layer and is solidified prior to re-entry into the pressure-transfer station.

2. Continuous method according to claim 1 in which said continuous web is an endless web of said plastic film.

3. Continuous method according to claim 1 in which said continuous web is a roll of said plastic film.

4. Continuous method according to claim 1 in which said plastic film comprises an oriented film having a thickness of from about 0.5 mil to 1.5 mils and is selected from the group consisting of polyethylene terephthalate, polyvinyl fluoride and polytetrafluoroethylene and laminates comprising said films.

5. Continuous method according to claim 1 in which said wax imaging composition is a hot-melt wax hextograph imaging composition and the used coating is melted in the recoating station, supplemented by coating thereon additional identical imaging composition, leveled and solidified by cooling.

* * * * *

UNITED STATES PATENT AND TRADEMARK OFFICE

CERTIFICATE OF CORRECTION

PATENT NO. : 3,989,569

DATED : November 2, 1976

INVENTOR(S) : Douglas A. Newman

It is certified that error appears in the above-identified patent and that said Letters Patent are hereby corrected as shown below:

Column 2, line 44, "printint" should be --printing--; column 3, line 15, "bu" should be --by--; column 3, line 62, "petroleum" should be --petrolatum--; column 4, line 17, after "and" insert the word --are--; claim 1, line 66, after "said" insert the word --coated--; claim 5, lines8 and 9, "hextograph" should be --hectograph--.

Signed and Sealed this

Fourth Day of January 1977

[SEAL]

*Attest:*

RUTH C. MASON
*Attesting Officer*

C. MARSHALL DANN
*Commissioner of Patents and Trademarks*